United States Patent [19]

Baldwin

[11] 4,237,528

[45] Dec. 2, 1980

[54] LUMINAIRE

[75] Inventor: Samuel L. Baldwin, East Flat Rock, N.C.

[73] Assignee: General Electric Company, Schenectady, N.Y.

[21] Appl. No.: 854,174

[22] Filed: Nov. 23, 1977

[51] Int. Cl.[2] ..... F23Q 3/00

[52] U.S. Cl. ..... 362/263; 362/296; 362/347; 362/350; 362/432

[58] Field of Search ..... 362/263, 347, 350, 296, 362/432, 297, 310, 348, 362

[56] References Cited

U.S. PATENT DOCUMENTS

| | | | |
|---|---|---|---|
| 2,226,222 | 12/1940 | Doane | 362/296 |
| 3,480,772 | 11/1969 | Grough | 362/350 |
| 3,539,795 | 11/1970 | Hawkey | 362/263 |
| 3,944,810 | 3/1976 | Grindle | 362/263 |

*Primary Examiner*—Benjamin R. Padgett
*Assistant Examiner*—J. L. Barr
*Attorney, Agent, or Firm*—Sidney Greenberg

[57] ABSTRACT

Indoor lighting fixture providing indirect asymmetrical light distribution. The fixture, which is adapted to be positioned adjacent a wall and below a ceiling, comprises a high intensity gaseous discharge lamp and an upwardly opening asymmetric reflector which is inclined to the horizontal for projecting light forwardly and laterally toward the ceiling while restricting light below the horizontal, so as to provide ample, uniformly distributed indirect light in the work area while shielding the light source from direct view of the room occupants to avoid glare.

8 Claims, 6 Drawing Figures

LUMINAIRE

The present invention relates to luminaires, and more particularly concerns indoor lighting fixtures adapted to be mounted adjacent a wall and to produce indirect lighting in a room.

With the advent of light sources having efficacies higher than fluorescent lamps, such as high pressure sodium vapor and metal halide (high intensity) gaseous discharge lamps (HID lamps), it is contemplated that such high intensity lamps will find substantially increased use for indoor applications such as in offices, classrooms and store merchandizing areas. There is an economic advantage in using especially the higher wattage lamps of this type, due to the greater efficiency, the reduced number of lighting fixtures required to illuminate a given area, and the consequent reduction in the time necessary for installation and maintenance of a lighting system comprising such fixtures. However, the brightness of the lighting fixture is usually too great when such higher wattage lamps are used in the conventional types of indoor luminaires.

It is an object of the invention to provide an improved indoor luminaire using a high intensity gaseous discharge lamp.

It is a particular object of the invention to provide a luminaire of the above type which is adapted to be mounted adjacent a wall and arranged so that the light emanating therefrom is principally directed toward the room or the work area.

Still another object of the invention is to provide a luminaire of the above type wherein the light source is shielded from the observer to avoid glare.

A further object of the invention is to provide a luminaire of the above type which produces substantial uniformity of illumination over an area eccentric to the luminaire.

Other objects and advantages will become apparent from the following description and the appended claims.

With the above objects in view, the present invention in one of its aspects relates to a luminaire adapted to be mounted eccentric to a work area below a ceiling or the like for indirectly lighting the work area comprising, in combination, a housing having side, front and rear walls defining an open top, the housing having a horizontal fore-and-aft axis intersecting the front and rear walls, a bowl-shaped reflector having a rim defining an opening, the reflector mounted within the housing with the plane of the opening tilted toward the front of the housing at an angle to the fore-and-aft axis, and an elongated high intensity gaseous discharge lamps mounted within the reflector and extending generally parallel to the plane of the reflector opening, the light emanating from the luminaire principally forwardly and laterally therefrom with substantially no light emanating therefrom below the fore-and-aft axis.

The invention will be better understood from the following description taken in conjunction with the accompanying drawings, in which.

Figure 1:
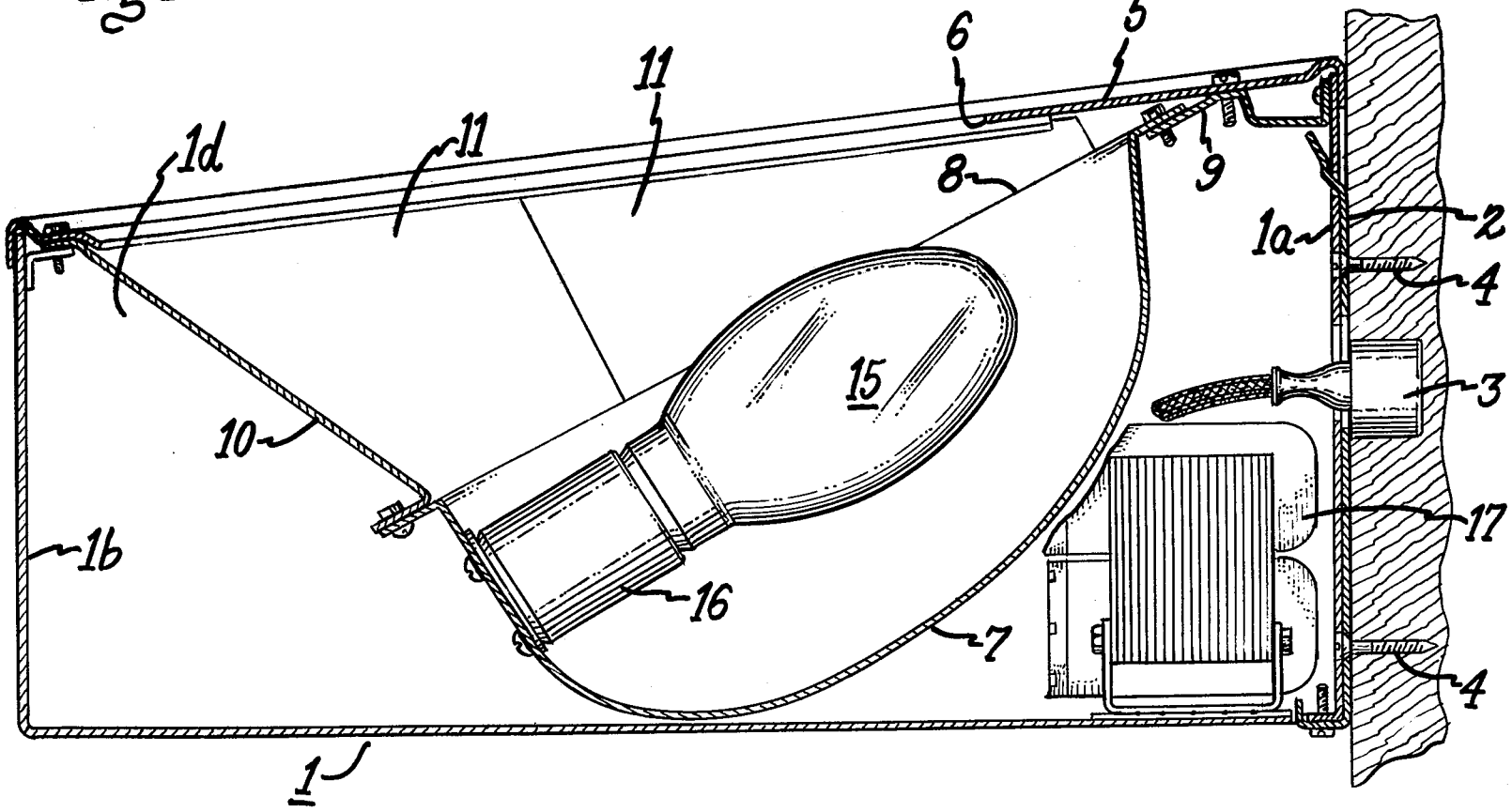
FIG. 1 is a longitudinal sectional view of a luminaire embodying the invention.
Figure 2:
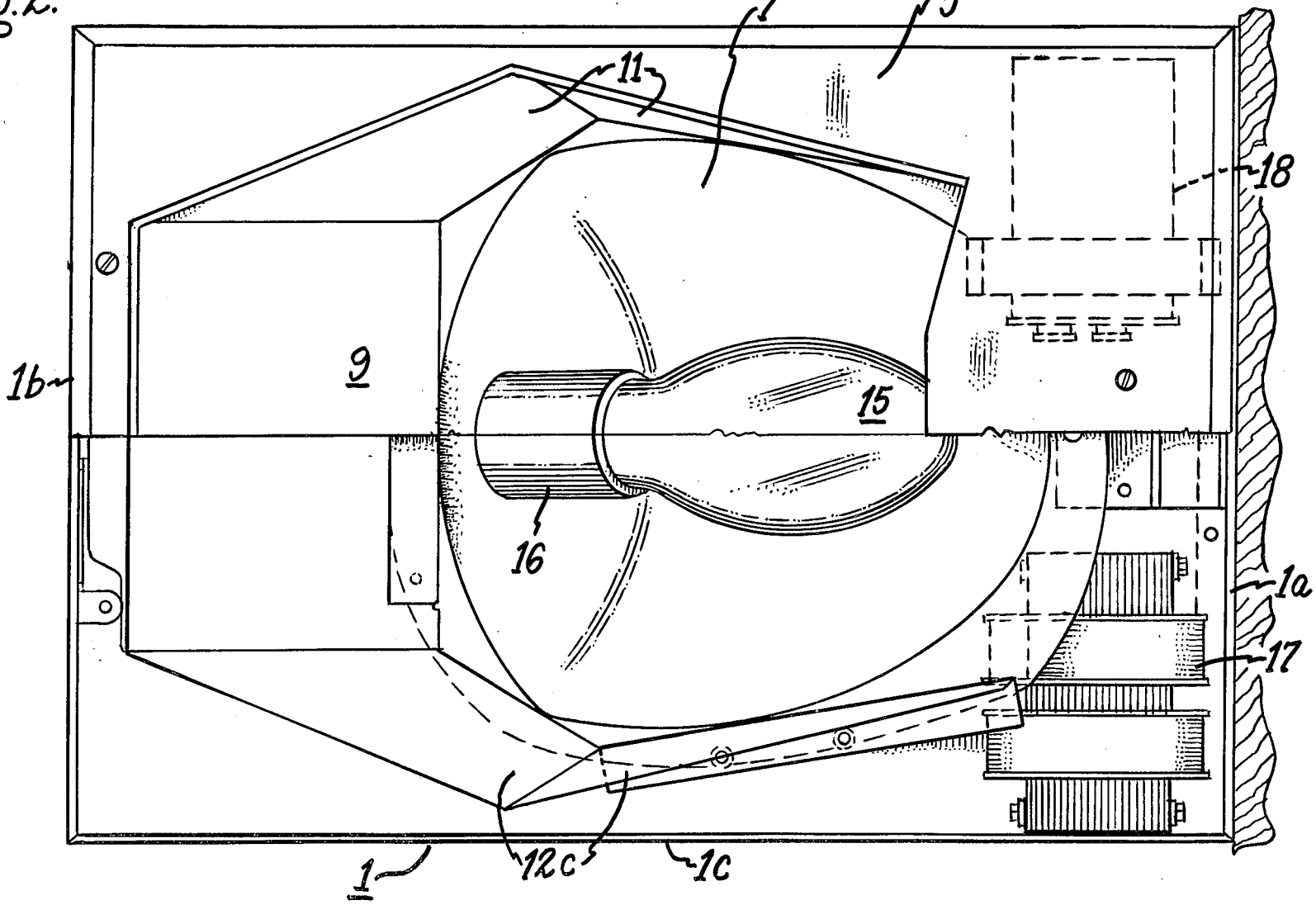
FIG. 2 is a top plan view, with parts broken away, of the FIG. 1 luminaire.

Referring now to the drawings, and particularly to FIGS. 1 and 2, there is shown a luminaire comprising a box-like housing 1 attached at its rear wall 1*a* to the wall of a room over an electrical outlet 3 by means of mounting plate 2 and screws 4 or the like. The interior of housing 1 is enclosed by front wall 1*b*, opposite sidewalls 1*c*, 1*d*, rear wall 1*a*, and bottom wall 1*e*, while frame 5 defines an opening 6 at its top, the plane of which slopes downwardly toward the front of the housing as shown. Mounted within housing 1 is ovate bowl-shaped reflector 7 arranged with its wider end at the front and with its opening 8 facing the top opening of housing 1 such that the plane of reflector opening 8 is tilted toward the front of the housing, typically at an angle of about 20°–40° to the horizontal and preferably about 30°.

In the illustrated embodiment, reflector 7 is secured at its rim to housing 1 by rear bracket 9 and by front reflector panel 10. The latter flat reflector panel together with side flat reflector panels 11, 12 surround reflector 7 on three sides and form a reflective cowl around reflector 7. It will be understood, however, that this cowl may be an integral part of reflector 7.

Lamp 15, which is typically a high intensity gaseous discharge lamp such as a metal halide lamp, is removably mounted in socket 16 secured to the inner surface of reflector 7, so as to position the light source of lamp 15 at about the light center of reflector 7. The arrangement is such that lamp 15 is entirely below the top opening of housing 1 and the longitudinal axis of the lamp extends generally parallel to the tilted rim of reflector 7 and is typically about 30° to the horizontal. It will be understood that socket 16 may alternatively be secured to the rear wall of reflector 7 while still mounting lamp 15 with its axis forwardly inclined substantially as described above.

Mounted within housing 1 are electrical operating components for operating lamp 15, such as ballast transformer 17 and capacitor 18.

The described arrangement is such that light emanates principally from the luminaire forwardly and to opposite sides of the luminaire and upwardly toward the ceiling for indirect illumination of the adjacent work area while being shielded so as to avoid glare in the eyes of the occupants of the work area, and to restrict the amount of light directed on the adjacent wall.

Figure 3:
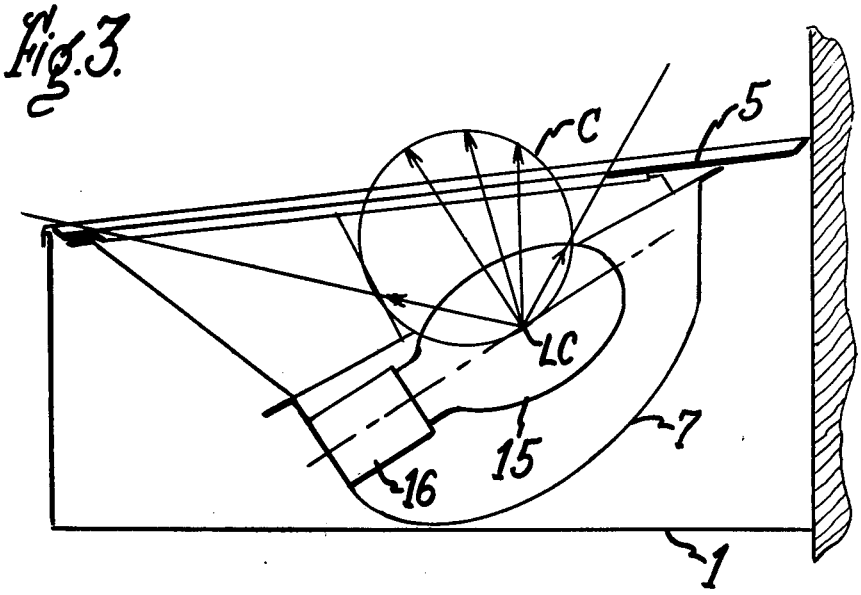
FIG. 3 is a somewhat diagrammatic side view of the luminaire showing the path of direct light rays therefrom.
Figure 4:
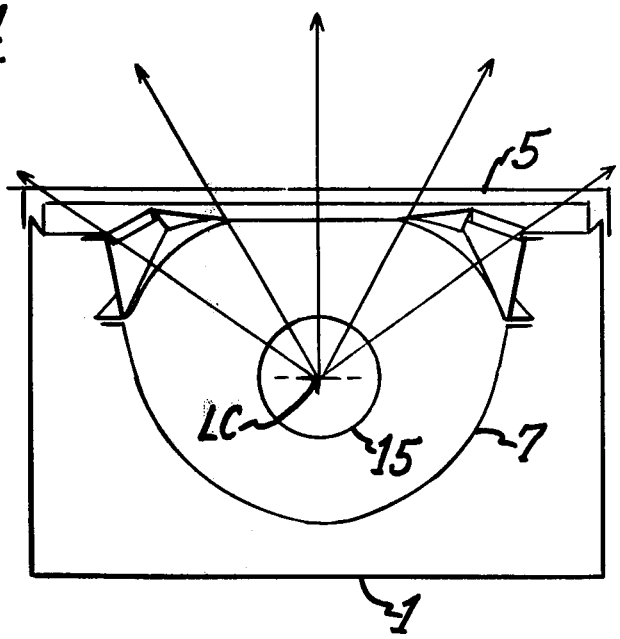
FIG. 4 is a diagrammatic view of the luminaire in transverse section showing the path of direct light rays therefrom.

As shown in FIGS. 3 and 4, the direct light from lamp 15 is cut off by the edges of housing frame 5 and reflector 7 in such manner that the direct rays from the light source are projected mainly upwardly toward the ceiling and forwardly of the luminaire, while being prevented from projecting below the horizontal. The direct light, as seen in FIG. 4, is distributed uniformly from side to side of the luminaire and varies from front to rear according to the cosine value of the angle to the perpendicular of the lamp axis, as depicted in FIG. 3. As understood by those versed in the art, the candle power distribution from an HID lamp in terms of the above cosine value may be represented by a circle tangent to the lamp axis, such as circle C. The lengths of the various light ray arrows shown intersecting circle C represent the relative intensities of those light beams with respect to the light ray which extends along the perpendicular to the lamp axis. Thus, the candle power and lumen output of HID lamps such as shown is highest at angles perpendicular to the lamp axis with substantially less light output near the ends of the lamp axis, and accordingly, in the arrangement shown, the light intensity of the beams directed rearwardly toward the wall is less than that of the light beams directed forwardly toward the ceiling.

Figure 6:
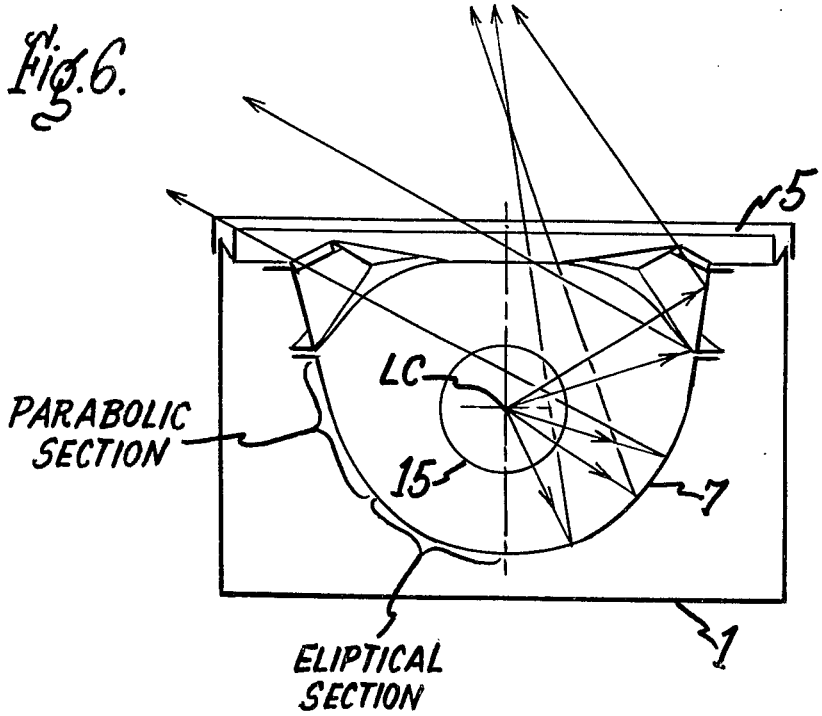
FIG. 6 is a view similar to FIG. 4 showing the path of reflected light rays.

As seen in the transverse section of reflector 7 illustrated in FIG. 6, the upper side portions of the reflector are parabolic in form while the bottom portions are elliptical, with the foci of these reflector sections being at the light center LC. Light from lamp 15 reflected by the parabolic sections is concentrated into parallel beams by those sections before passing out of the luminaire toward opposite sides thereof preferably at angles of 20°–40° to the horizontal and forwardly preferably at angles of 20°–40°. The light incident on the elliptical sections from the light center is re-focused through a point above the light source to prevent reflecting the light back into the source, and the light beams are thereby spread laterally after passing out of the luminaire. As a result, the reflected light is uniformly distributed toward the ceiling for reflection therefrom to the work area.

In longitudinal section, the sides of reflector 7 are preferably parabolic in both upper and lower portions.

Figure 5:
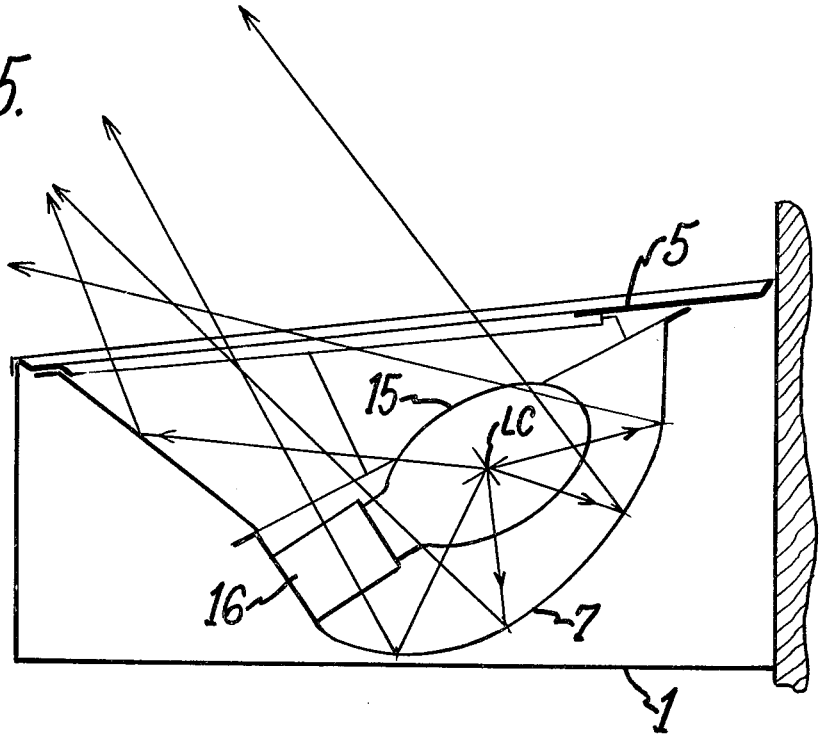
FIG. 5 is a view similar to FIG. 3 showing the path of reflected light rays.

FIG. 5 shows a longitudinal vertical section of reflector 7. As seen therein, the portion of reflector 7 adjacent the wall directs the incident light toward the center of the area to be illuminated. The contour of the bottom portion of the reflector is such that the incident light is generally concentrated without being focused and then forms a spread beam beyond the point of maximum concentration.

While a reflector of particular contour has been disclosed, it will be understood that reflectors with contours other than that particularly shown and described may alternatively be employed for appropriately reflecting the light in accordance with the principles of the invention.

The reduced intensity of light directed toward the adjacent wall by virtue of the described arrangement provides the advantage that a greater amount of light is directed toward the ceiling which generally has higher reflectivity than the wall, and, further, the undesirable effect called "scalloping" caused by bright spots on the walls at each fixture is reduced.

Typically, the described asymmetric indirect lighting fixture is mounted on the wall of a room as described for directing light into the adjacent room or work area. However, other mounting arrangements could be used in practicing the inventions, as, for example, mounting the fixture on other supports such as a pole, a partition or a file cabinet or the like, where the support is located at the side of or eccentric to the area to be illuminated.

While the present invention has been described with reference to particular embodiments thereof, it will be understood that numerous modifications may be made by those skilled in the art without actually departing from the scope of the invention. Therefore, the appended claims are intended to cover all such equivalent variations as come within the true spirit and scope of the invention.

What I claim as new and desire to secure by Letters Patent of the United States is:

1. A luminaire adapted to be mounted eccentric to a work area below a ceiling or the like for indirectly lighting the work area comprising, in combination, a housing having side, front and rear walls defining an open top, said housing having a horizontal fore-and-aft axis intersecting said front and rear walls, a bowl-shaped reflector having a light center therein and a rim defining an opening, said reflector mounted within said housing with its opening facing the open top of said housing and being tilted toward the front of said housing so that the plane of said opening is at an angle to said fore-and-aft axis, and an elongated high intensity gaseous discharge lamp mounted within said reflector at said light center and extending generally parallel to the plane of said reflector opening, the light emanating upwardly from the luminaire principally forwardly and laterally therefrom with substantially no light emanating therefrom below said fore-and-aft axis.

2. A luminaire as defined in claim 1, said housing having a top frame defining a top housing opening and providing a cut-off at predetermined angles for direct and reflected light rays emanating from said housing.

3. A luminaire as defined in claim 2, the sides of said reflector having upper portions of parabolic contour in vertical section with foci substantially at said light center, and having lower portions of elliptical contour in vertical section with foci substantially at said light center.

4. A luminaire as defined in claim 2, said angle to said fore-and-aft axis being about 20°–40°.

5. A luminaire as defined in claim 4, said reflector being substantially ovate and having front and rear ends, and socket means secured within said reflector to the front end thereof, said lamp having a base attached to said socket means and extending therefrom toward the rear end of said reflector.

6. A luminaire as defined in claim 1, including reflecting means extending around said reflector at said opening thereof and upwardly to the top of said housing.

7. A luminaire as defined in claim 1, the bottom of said reflector being contoured to reflect light incident thereon principally upwardly and forwardly from said housing.

8. A luminaire as defined in claim 7, the sides of said reflector being contoured to reflect light incident thereon principally upwardly and laterally from said housing.

* * * * *